US012704305B2

(12) United States Patent
Venkata et al.

(10) Patent No.: US 12,704,305 B2
(45) Date of Patent: Aug. 11, 2026

(54) COUNTERTOP ICE MAKER APPLIANCE AND METHODS OF OPERATING THE SAME

(71) Applicant: Haier US Appliance Solutions, Inc., Wilmington, DE (US)

(72) Inventors: Srikanth Raavi Venkata, Louisville, KY (US); Eric Muzzillo, Louisville, KY (US); Samuel Vincent DuPlessis, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 182 days.

(21) Appl. No.: 18/448,813

(22) Filed: Aug. 11, 2023

(65) Prior Publication Data

US 2025/0052468 A1 Feb. 13, 2025

(51) Int. Cl.
*F25C 1/147* (2018.01)

(52) U.S. Cl.
CPC ..... *F25C 1/147* (2013.01); *F25C 2301/00* (2013.01); *F25C 2400/04* (2013.01); *F25C 2600/02* (2013.01); *F25C 2600/04* (2013.01); *F25C 2700/10* (2013.01)

(58) Field of Classification Search
CPC .. F25C 1/147; F25C 2301/00; F25C 2400/04; F25C 2600/02; F25C 2600/04; F25C 2700/10; F25B 49/022; F25B 2600/021
USPC ..... 62/340
See application file for complete search history.

(56) References Cited

U.S. PATENT DOCUMENTS 2,952,141 A * 9/1960 Nelson ..... F25C 5/142 62/344
3,126,719 A * 3/1964 Swatsick ..... F25C 1/147 62/320
3,196,624 A * 7/1965 Reynolds ..... F25C 5/142 222/2
3,501,927 A * 3/1970 Wadsack ..... F25C 1/147 62/320
3,511,059 A * 5/1970 Hoenisch ..... F25C 5/187 62/138
4,328,681 A * 5/1982 Sakamoto ..... F25C 1/147 62/157
4,475,357 A * 10/1984 Linstromberg ..... F25C 1/04 62/157
4,644,757 A * 2/1987 Hida ..... F25C 1/147 62/233

(Continued)

FOREIGN PATENT DOCUMENTS

JP 5253924 B2 7/2013

*Primary Examiner* — Eric S Ruppert
*Assistant Examiner* — Kirstin U Oswald
(74) *Attorney, Agent, or Firm* — Dority & Manning, P.A.

(57) ABSTRACT

A countertop ice maker appliance includes a compressor, a condenser, a condenser fan, and a motor assembly. A method of operating the countertop ice maker includes initiating a standard ice making cycle, the standard ice making cycle including a first set of parameters for each of the motor assembly, the compressor, and the condenser fan; receiving, via the user interface, a signal to initiate an adjusted ice making cycle; adjusting the first set of parameters to form a second set of parameters for each of the motor assembly, the compressor, and the condenser fan; and initiating the adjusted ice making cycle according to the second set of parameters.

20 Claims, 6 Drawing Sheets

(56) References Cited

U.S. PATENT DOCUMENTS

| | | | | |
|---|---|---|---|---|
| 5,325,679 | A * | 7/1994 | Tatematsu | F25C 1/147 62/233 |
| 5,440,892 | A * | 8/1995 | Tatematsu | F25C 1/147 62/135 |
| 6,655,158 | B1 | 12/2003 | Wiseman et al. | |
| 2002/0157406 | A1* | 10/2002 | Billman | F25C 1/12 62/177 |
| 2003/0010055 | A1* | 1/2003 | Kuroyanagi | F25C 1/147 62/139 |
| 2003/0089120 | A1* | 5/2003 | Kampert | F25C 1/147 62/137 |
| 2003/0150236 | A1* | 8/2003 | Ross | A23G 9/225 62/342 |
| 2003/0182957 | A1* | 10/2003 | Hu | F25D 17/065 62/228.4 |
| 2004/0194481 | A1* | 10/2004 | Nomura | F25C 1/147 62/353 |
| 2004/0231354 | A1* | 11/2004 | Tsuchikawa | F25C 5/142 62/353 |
| 2005/0028549 | A1* | 2/2005 | Kuroyanagi | F25C 5/142 62/352 |
| 2005/0081554 | A1* | 4/2005 | Ross | A23G 9/163 62/342 |
| 2006/0277937 | A1* | 12/2006 | Schlosser | F25C 5/20 62/340 |
| 2007/0006606 | A1* | 1/2007 | Kaga | F25C 5/142 62/135 |
| 2009/0235674 | A1 | 9/2009 | Kern et al. | |
| 2009/0326716 | A1* | 12/2009 | Kodama | F25C 1/147 62/340 |
| 2011/0041542 | A1* | 2/2011 | Brunner | F25C 5/142 62/498 |
| 2020/0124332 | A1 | 4/2020 | Gilioli et al. | |

* cited by examiner

COUNTERTOP ICE MAKER APPLIANCE AND METHODS OF OPERATING THE SAME

FIELD OF THE INVENTION

The present subject matter relates generally to countertop ice maker appliances, and more particularly to methods of adjusting an ice output rate of countertop ice maker appliances.

BACKGROUND OF THE INVENTION

Ice makers generally produce ice for the use of consumers, such as in drinks being consumed, for cooling foods or drinks to be consumed and/or for other various purposes. Recently, stand-alone ice makers have been developed. These ice makers are separate from refrigerator appliances and provide independent ice supplies. For instance, countertop ice makers may be stand-alone ice makers which do not require plumbing for supplying water or draining melt water therefrom. These countertop ice makers may be capable of producing nugget ice, or ice which is maintained at a temperature above the freezing point of water.

Current countertop ice makers have several drawbacks. For example, conventional countertop ice makers have fixed refrigeration and ice forming components which produce ice at a fixed rate. In times of heavy ice usage, a high demand for the ice may render the countertop ice maker insufficient.

Accordingly, a countertop ice maker appliance which obviates one or more of the above-mentioned drawbacks would be beneficial. In particular, a countertop ice maker appliance which allows for multiple ice making rates would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a countertop ice maker appliance is provided. The countertop ice maker appliance may include a cabinet including a user interface; a motor assembly to selectively drive an auger; a sealed refrigeration system including a compressor and a condenser, wherein the compressor is a variable speed compressor; a condenser fan to selectively urge a flow of air over the condenser; and a controller operably coupled with the motor assembly, the compressor, and the condenser fan, the controller configured to perform an operation. The operation may include initiating a standard ice making cycle, the standard ice making cycle including a first set of parameters for each of the motor assembly, the compressor, and the condenser fan; receiving, via the user interface, a signal to initiate an adjusted ice making cycle; adjusting the first set of parameters to form a second set of parameters for each of the motor assembly, the compressor, and the condenser fan; and initiating the adjusted ice making cycle according to the second set of parameters.

In another exemplary embodiment of the present disclosure, a method of operating a countertop ice maker appliance is provided. The countertop ice maker appliance may include a compressor, a condenser, a condenser fan, and a motor assembly. The method may include initiating a standard ice making cycle, the standard ice making cycle including a first set of parameters for each of the motor assembly, the compressor, and the condenser fan; receiving, via the user interface, a signal to initiate an adjusted ice making cycle; adjusting the first set of parameters to form a second set of parameters for each of the motor assembly, the compressor, and the condenser fan; and initiating the adjusted ice making cycle according to the second set of parameters.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
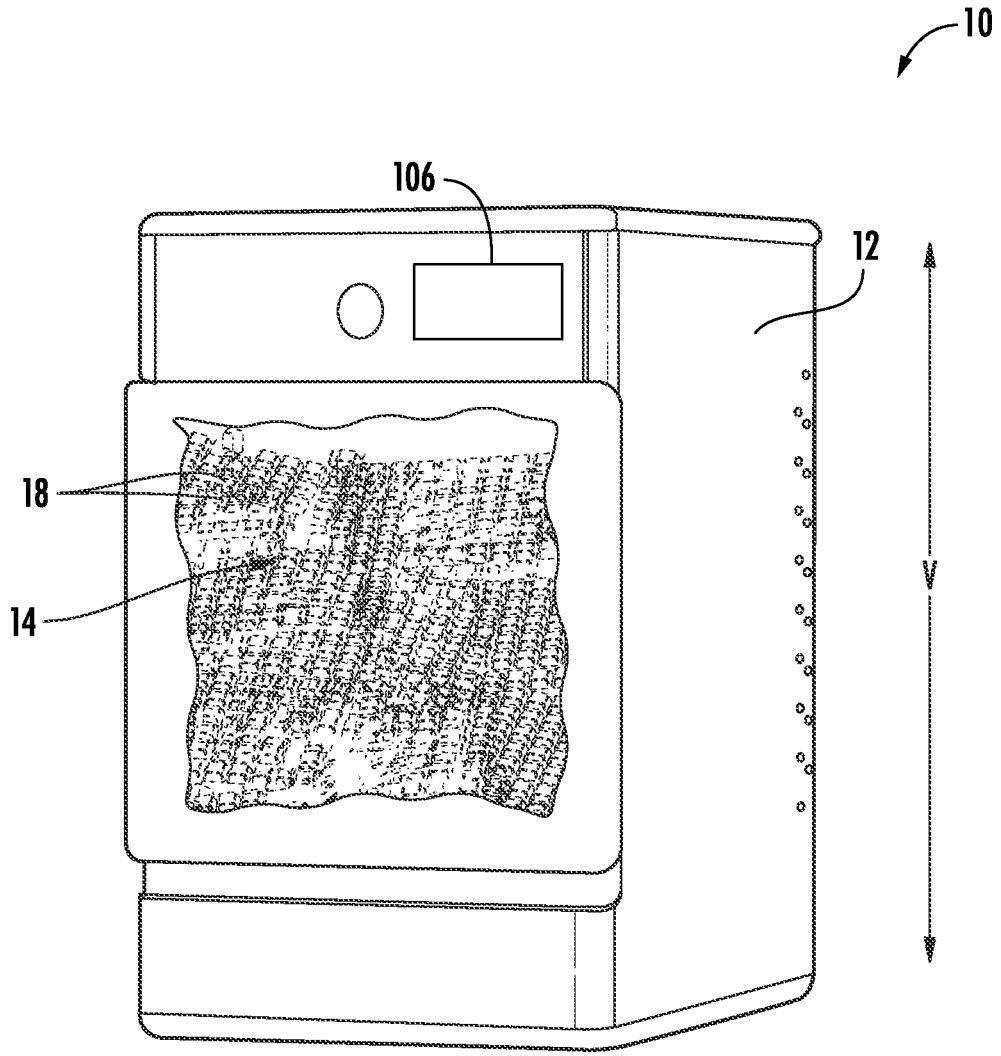
FIG. 1 is a perspective view of a stand-alone ice making appliance in accordance with one exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
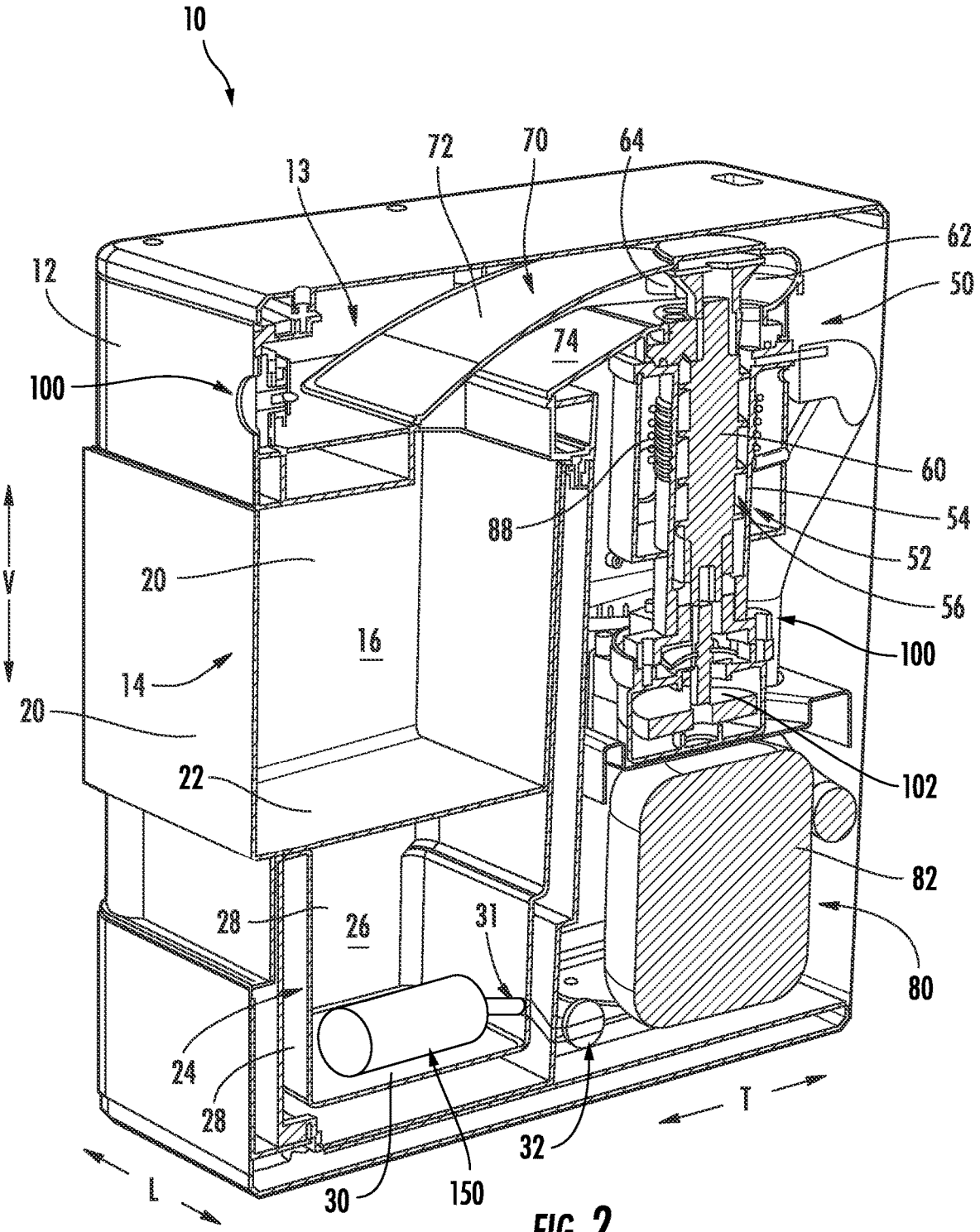
FIG. 2 is a perspective sectional view of the stand-alone ice making appliance of FIG. 1 in accordance with one exemplary embodiment of the present disclosure.
Figure 3:
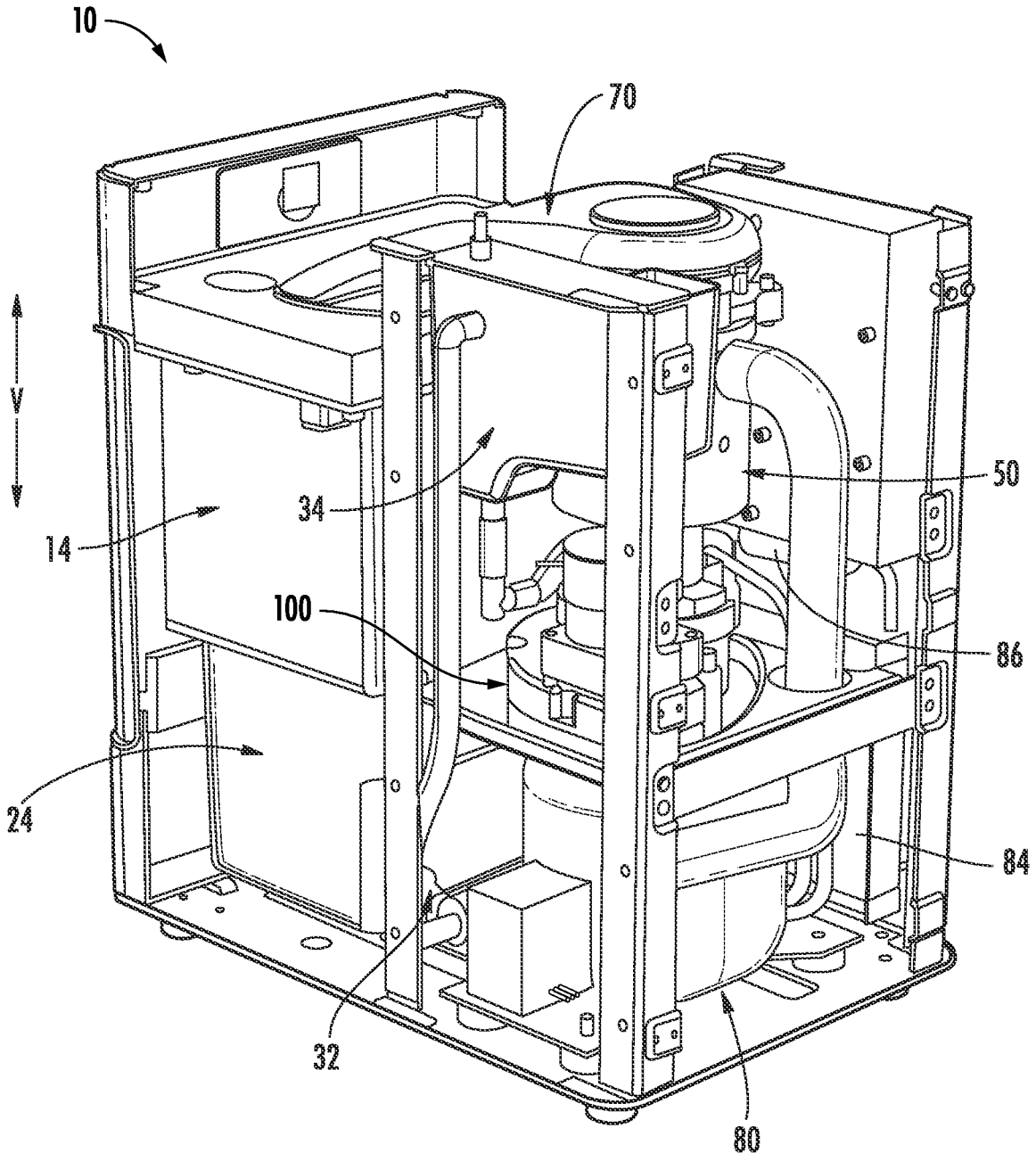
FIG. 3 is a rear perspective view (with a casing removed) of the stand-alone ice making appliance of FIG. 1 in accordance with one exemplary embodiment of the present disclosure.
Figure 4:
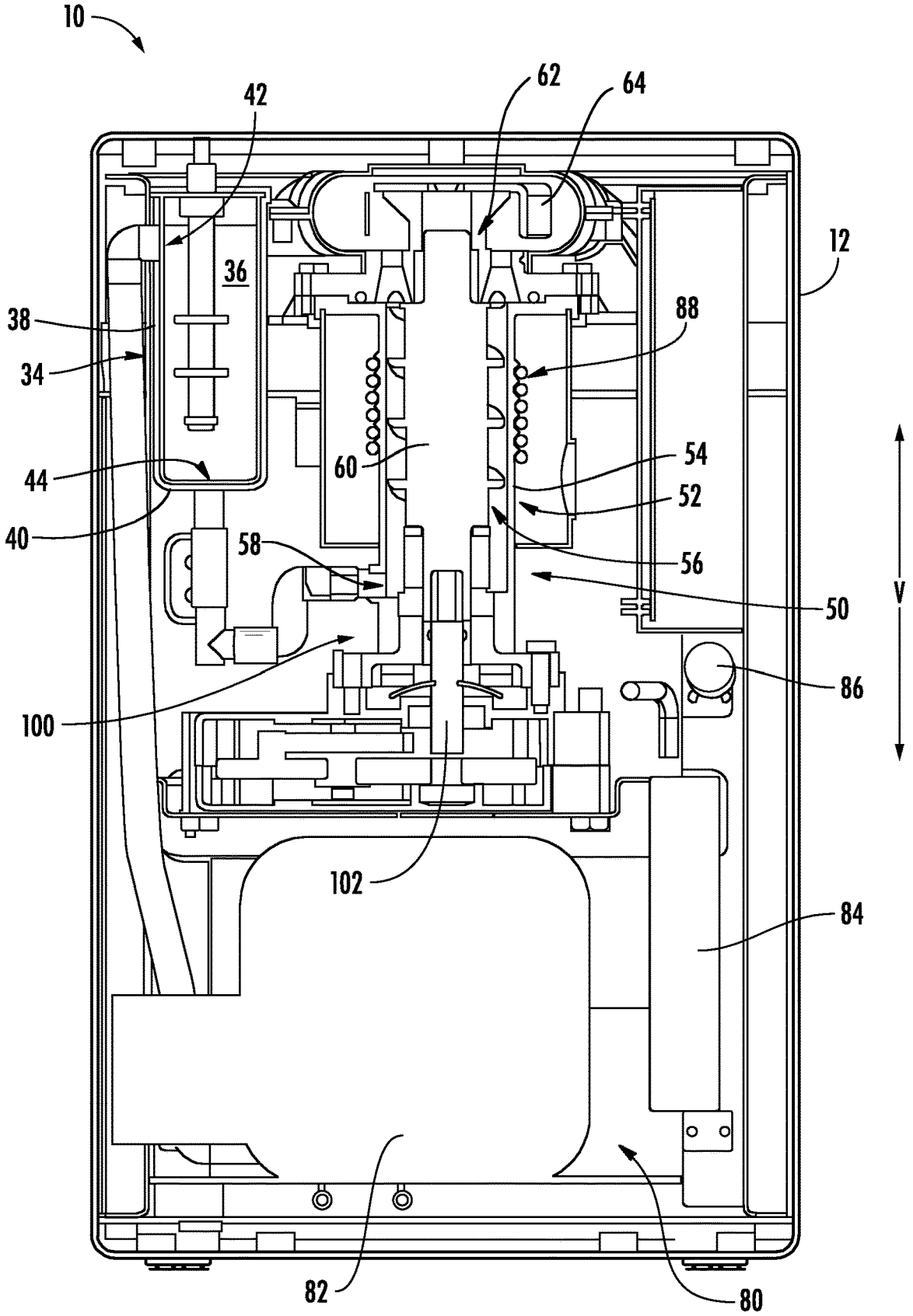
FIG. 4 is a rear sectional view of the stand-alone ice making appliance of FIG. 1 in accordance with one exemplary embodiment of the present disclosure.

Referring now to FIG. 1, one embodiment of a countertop appliance, in this case a stand-alone ice making appliance 10, in accordance with the present disclosure is illustrated. As shown, appliance 10 includes an outer casing 12 which generally at least partially houses various other components of the appliance therein 10. A container 14 is also illustrated. Container 14 may define a first storage volume 16 for the receipt and storage of ice 18 therein. A user of the appliance 10 may access ice 18 within the container 14 for consumption or other uses. Container 14 may include one or more sidewalls 20 and a base wall 22 (see FIG. 2), which may together define the first storage volume 16. In exemplary embodiments, at least one sidewall 20 may be formed from a clear, see-through (i.e. transparent or translucent) material, such as a clear glass or plastic, such that a user can see into the first storage volume 16 and thus view ice 18 therein. Further, in exemplary embodiments, container 14 may be removable, such as from the outer casing 12, by a user. This facilitates easy access by the user to ice within the container 14 and further, for example, may provide access to a water tank 24 (see FIG. 2) of the appliance 10.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. The removable container 14 allows easy access to ice and allows the container 14 to be moved to a different position from the remainder of the appliance 10 for ice usage purposes. Additionally, in exemplary embodiments as discussed herein, appliance 10 is configured to make nugget ice (as discussed herein) which has become increasingly popular with consumers.

Appliance 100 may include a user interface 106. For instance, user interface 106 may be positioned on outer casing 12 (e.g., on a front or top thereof). User interface 106 may include one or more inputs, such as buttons, dials, switches, or the like. For instance, user interface 106 may include a touch panel to receive touch inputs thereto. A user may thus select one or more operating parameters of appliance 10 via user interface 106. Additionally or alternatively, user interface 106 may include a display or display screen. The display may provide information to users of appliance in the form of messages, indicators, lights, or the like. User interface 106 may include a speaker or other noise emitting device. Thus, a user may interact with appliance 10 via user interface 106 and receive certain messages, warnings, indications, outputs, notifications, or the like via the display and/or the speaker.

Referring to FIGS. 2 through 5, various other components of appliance 10 in accordance with the present disclosure are illustrated. For example, as mentioned, appliance 10 may include a water tank 24. The water tank 24 may define a storage volume 26 (also known as a second storage volume) for the receipt and holding of water. Water tank 24 may include one or more sidewalls 28 and a base wall 30 which may together define the second storage volume 26. In exemplary embodiments, the water tank 24 may be disposed below the container 14 along a vertical direction V defined for the appliance 10, as shown.

As discussed, in exemplary embodiments, water may be provided to the water tank 24 for use in forming ice. Accordingly, appliance 10 may further include a pump 32. Pump 32 may be in fluid communication with the second storage volume 26. For example, water may be flowable from the second storage volume 26 through an opening 31 defined in the water tank 24, such as in a sidewall 28 thereof, and may flow through a conduit to and through pump 32. Pump 32 may, when activated, actively flow water from the second storage volume 26 therethrough and from the pump 32.

Water actively flowed from pump 32 may be flowed (for example through a suitable conduit) to a reservoir 34. For example, reservoir 34 may define a third storage volume 36, which may be defined by one or more sidewalls 38 and a base wall 40. Third storage volume 36 may, for example, be in fluid communication with the pump 32 and may thus receive water that is actively flowed from the water tank 24, such as through the pump 32. For example, water may be flowed into the third storage volume 36 through an opening 42 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through opening 44 and through suitable conduits, from third storage volume 36 to ice maker 50.

Ice maker 50 generally receives water, such as from reservoir, and freezes the water to form ice 18. While any suitable style of ice maker is within the scope and spirit of the present disclosure, in exemplary embodiments, ice maker 50 is a nugget ice maker, and in particular is an auger-style ice maker. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening 58 may be defined in a sidewall 54. Water may be flowed from third storage volume 36 through opening 58 (such as via a suitable conduit) into interior volume 56.

As illustrated, an auger 60 may be disposed at least partially within casing 52. During operation, auger 60 may rotate. Water within casing 52 may at least partially freeze due to heat exchange, such as with a refrigeration system as discussed herein. The at least partially frozen water may be lifted by auger 60 from casing 52. Further, in exemplary embodiments, the at least partially frozen water may be directed by auger 60 to and through an extruder 62. The extruder 62 may extrude the at least partially frozen water to form ice, such as nuggets of ice 18.

For instance, auger 60 may be driven by a motor assembly 100. Motor assembly 100 may thus be operably connected to auger 60 such that auger 60 is selectively rotated (e.g., at a predetermined speed) upon motor assembly 100 being driven. In detail, motor assembly may include a motor 102. As used herein, "motor" may refer to any suitable drive motor and/or transmission assembly for rotating auger 60. For example, motor assembly 100 may include a brushless DC electric motor, a stepper motor, or any other suitable type or configuration of motor. For example, motor assembly 100 may include an AC motor, an induction motor, a permanent magnet synchronous motor, or any other suitable type of AC motor. In addition, motor assembly 100 may include any suitable transmission assemblies, clutch mechanisms, or other components. According to an exemplary embodiment, motor assembly 100 may be operably coupled to a controller (described below), which is programmed to rotate auger 60 as described herein.

According to at least some embodiments, motor 102 is a variable speed motor. For instance, motor 102 may be a brushless DC motor capable of operating (e.g., rotating) at variable speeds. Motor 102 may thus be selectively operated or directed (e.g., via the controller) at a predetermined percentage of a maximum power or maximum motor speed. For one example, appliance may be capable of operating in a plurality of modes. Each of the plurality of modes may incorporate different or adjusted operating parameters. Thus, motor 102 may be operated at a reduced capacity in a normal or standard mode. For instance, in the standard mode, motor 102 may be driven at between about 60% and about 80% of a total capacity (e.g., maximum motor speed). In an advanced mode (e.g., referred to as a "turbo" mode), motor 102 may be driven at 100% capacity, or maximum motor speed. However, it should be understood that the ranges provided herein are given by way of example only, and that any suitable motor speed or capacity may be incorporated with the variable speed motor.

Formed ice 18 may be provided by ice maker 50 to container 14, and may be received in the first storage volume 16 thereof. For example, ice 18 formed by auger 60 and/or extruder 62 may be provided to container 14. In exemplary embodiments, appliance 10 may include a chute 70 for directing ice 18 produced by ice maker 50 towards first storage volume 16. For example, as shown, chute 70 is generally positioned above container 14 along the vertical direction V. Thus, ice may slide off of chute 70 and drop into storage volume 16 of container 14. Chute 70 may, as shown, extend between ice maker 50 and container 14, and may include a body 72 which defines a passage 74 therethrough. Ice 18 may be directed from ice maker 50 (such as from the auger 60 and/or extruder 62) through passage 74 to container 14. In some embodiments, for example, a sweep 64, which may for example be connected to and rotate with the auger, may contact the ice emerging through the extruder 62 from the auger 60 and direct the ice through the passage 74 to the container 14.

As discussed, water within casing 52 may at least partially freeze due to heat exchange, such as with a refrigeration system. In exemplary embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86 and an evaporator 88. Evaporator 88 may, for example, be in thermal communication with casing 52 in order to remove heat from the interior volume 56 and water therein during operation of sealed system 80. For example, evaporator 88 may at least partially surround casing 52. In particular, evaporator 88 may be a conduit coiled around and in contact with casing 52, such as the sidewall(s) 54 thereof.

Figure 5:
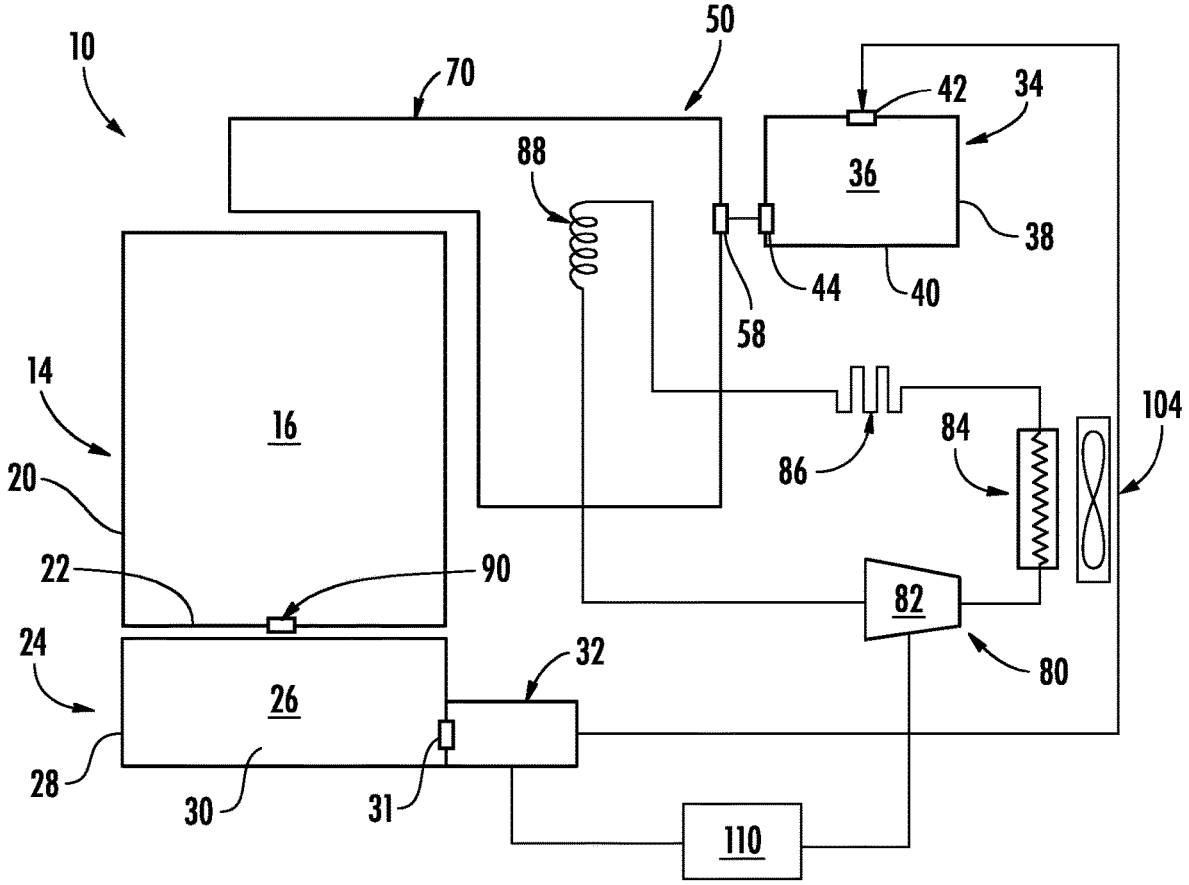
FIG. 5 is a schematic diagram of a stand-alone ice making appliance in accordance with one exemplary embodiment of the present disclosure.

During operation of sealed system 80, refrigerant exits evaporator 88 as a fluid in the form of a superheated vapor and/or vapor mixture. Upon exiting evaporator 88, the refrigerant enters compressor 82 wherein the pressure and temperature of the refrigerant are increased such that the refrigerant becomes a superheated vapor. The superheated vapor from compressor 82 enters condenser 84 wherein energy is transferred therefrom and condenses into a saturated liquid and/or liquid vapor mixture. This fluid exits condenser 84 and travels through throttling device 86 that is configured for regulating a flow rate of refrigerant therethrough. Upon exiting throttling device 86, the pressure and temperature of the refrigerant drop at which time the refrigerant enters evaporator 88 and the cycle repeats itself. In certain exemplary embodiments, e.g., as illustrated in FIG. 5, throttling device 86 may be a capillary tube. Notably, in some embodiments, sealed system 80 may additionally include fans for facilitating heat transfer to/from the condenser 84 and evaporator 88.

For instance, sealed system 80 may include a condenser fan or air handler 104. Condenser fan 104 may be positioned adjacent to condenser 84 (e.g., within outer casing 12). Condenser fan 104 may be configured to urge a flow of air over condenser 84 to increase a heat transfer rate therein (e.g., to remove heat from the refrigerant within condenser 84). According to the illustrated exemplary embodiment, condenser fan 104 is an axial fan positioned beside condenser 84. However, it should be appreciated that according to alternative embodiments, condenser fan 104 may be positioned at any other suitable location and may be any other suitable fan type, such as a tangential fan, a centrifugal fan, etc.

In addition, according to an exemplary embodiment, condenser fan 104 is a variable speed fan such that it may rotate at different rotational speeds, thereby generating different air flow rates. In this manner, the amount of air motivated over condenser 84 may be adjusted according to different operating modes. Moreover, by pulsing the operation of condenser fan 104 or throttling condenser fan 104 between different rotational speeds, the flow of air over condenser 84 may have a different flow velocity or may generate a different flow pattern within outer casing 12.

Compressor 82 may be a variable speed compressor. In this regard, compressor 82 may be operated at various speeds depending on the current ice production needs of the user and the demand from sealed system 80. For example, according to an exemplary embodiment, compressor 82 may be configured to operate at any speed between a minimum speed, e.g., 1500 revolutions per minute (RPM), to a maximum rated speed, e.g., 3500 RPM. Notably, use of variable speed compressor 82 enables efficient operation of sealed system 80 (and thus appliance 10), minimizes energy usage and noise when compressor 82 does not need to operate at full speed, and ensures a required production of ice 18.

Specifically, according to an exemplary embodiment, compressor 82 may be an inverter compressor. In this regard, compressor 82 may include a power inverter, power electronic devices, rectifiers, or other control electronics suitable for converting an alternating current (AC) power input into a direct current (DC) power supply for the compressor. The inverter electronics may regulate the DC power output to any suitable DC voltage that corresponds to a specific operating speed of compressor. In this manner compressor 82 may be regulated to any suitable operating speed, e.g., from 0% to 100% of the full rated power and/or speed of the compressor. This may facilitate precise compressor operation at the desired operating power and speed, thus meeting system needs while maximizing efficiency and minimizing unnecessary system cycling, energy usage, and noise.

As discussed, in exemplary embodiments, ice 18 may be nugget ice. Nugget ice may be defined by ice that that is maintained or stored (i.e. in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than 60 degrees Fahrenheit.

Ice 18 held within the first storage volume 16 may gradually melt. The melting speed is increased for nugget ice due to the increased maintenance/storage temperature. Accordingly, drain features may advantageously be provided in the container for draining such melt water. Additionally, and advantageously, the melt water may in exemplary embodiments be reused by appliance 10 to form ice.

For example, in some embodiments as illustrated in FIG. 5, a drain aperture 90 may be defined in base wall 22. Drain aperture 90 may allow water to flow from the first storage volume 16 and container 14 generally. Further, in exemplary embodiments, water flowing from the first storage volume 16 and container 14 may, due to gravity and the vertical alignment of the container 14 of water tank 24, flow into the second storage volume 26.

In exemplary embodiments, appliance 10 may further include a controller 110. Controller 110 may for example, be configured to operate the appliance 10 based on, for example, user inputs to the appliance 10 (such as to a user interface thereof), inputs from various sensors disposed within the appliance 10, and/or other suitable inputs. Controller 110 may for example include one or more memory devices and one or more microprocessors, such as general or special purpose microprocessors operable to execute programming instructions or micro-control code associated with appliance 10 operation. The memory may represent random access memory such as DRAM, or read only memory such as ROM or FLASH. In one embodiment, the processor executes programming instructions stored in memory. The memory may be a separate component from the processor or may be included onboard within the processor.

In exemplary embodiments, controller 110 may be in operative communication with the pump 32. Such operative communication may be via a wired or wireless connection and may facilitate the transmittal and/or receipt of signals by the controller 110 and pump 32. Controller 110 may be configured to activate the pump 32 to actively flow water. For example, controller 110 may activate the pump 32 to actively flow water therethrough when, for example, reservoir 34 requires water. A suitable sensor(s), for example, may be provided in the third storage volume 36. The sensor(s) may be in operative communication with the controller 110 and may transmit signals to the controller 110 which indicate whether or not additional water is desired in the reservoir 34. When controller 110 receives a signal that water is desired, controller 110 may send a signal to pump 32 to activate that pump.

It should additionally be noted that, in exemplary embodiments, controller 110 may be in operative communication with the sealed system 80, such as with the compressor 82 thereof, and may activate the sealed system 80 as desired or required for ice making purposes. For instance, controller 110 may selectively control, direct, or operate compressor 82 at a selected or predetermined speed or output. Moreover, controller 110 may be operably connected with condenser fan 104. Thus, controller 110 may selectively control, direct, or operate condenser fan 104 at a selected or predetermined speed or output. As would be understood, controller 110 may additionally or alternatively be operably connected to other elements of appliance, such as user interface 106, evaporator 88 (and an optional evaporator fan), etc.

Figure 6:
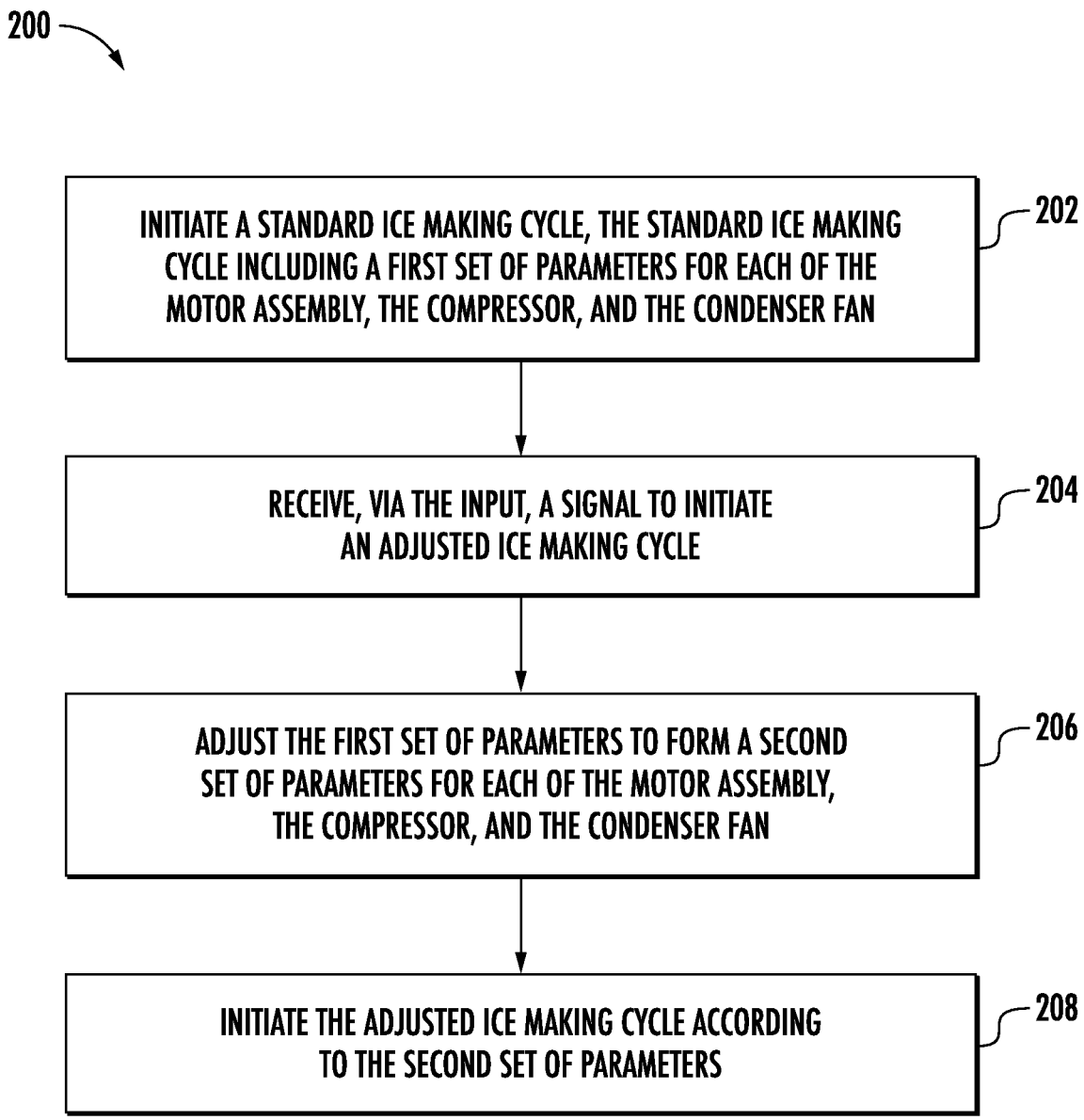
FIG. 6 provides a flow chart illustrating a method of operating a stand-alone ice making appliance according to one exemplary embodiment.

Now that the general descriptions of an exemplary appliance have been described in detail, a method 200 of operating an appliance (e.g., countertop ice maker appliance 10) will be described in detail. Although the discussion below refers to the exemplary method 200 of operating appliance 10, one skilled in the art will appreciate that the exemplary method 200 is applicable to any suitable domestic appliance capable of making or forming ice cubes (e.g., such as a clear ice machine, a crescent ice machine, etc.). In exemplary embodiments, the various method steps as disclosed herein may be performed by controller 110 and/or a separate, dedicated controller. FIG. 6 provides flow charts illustrating a method of operating a countertop ice maker appliance. Hereinafter, method 200 will be described with specific reference to FIG. 6.

At step 202, method 200 may include initiating a standard ice making cycle. The standard ice making cycle may include a first set of parameters for each of a motor assembly (e.g., motor assembly 100), a compressor (e.g., compressor 82), and a condenser fan (e.g., condenser fan 104). In detail, as mentioned above, the appliance may include or incorporate a variable speed compressor capable of operating at varying speeds (e.g., between 0% and 100%). The first set of parameters may thus include a compressor capacity or speed. Thus, according to the standard ice making cycle, the compressor capacity may be between about 60% and about 80% of a total compressor capacity. The standard ice making cycle may produce ice at a first rate. For instance, the first rate may be between about 1.5 pounds of ice per hour and about 2 pounds of ice per hour. Accordingly, the compressor may be operated at a reduced level (e.g., less than maximum) for the standard ice making cycle.

The first set of parameters may include a motor speed (e.g., a rotational speed of motor 102). For instance, the motor speed may represent a motor power output or an equivalent rotational speed of an auger (e.g., auger 60). As mentioned above, the motor may be a variable speed motor (e.g., capable of operating at variable speeds or power levels). According to the standard ice making cycle, the motor speed may be between about 60% and about 80% of a total motor speed (or power output). Accordingly, the motor may be operated at a reduced level, speed, or output (e.g., less than maximum) for the standard ice making cycle.

The first set of parameters may include a fan speed (e.g., a condenser fan speed) of the condenser fan. For instance, the fan speed may represent a fan airflow output or rotational velocity of the condenser fan. As mentioned above, the condenser fan may be a variable speed fan (e.g., capable of rotating at variable rotational speeds). According to the standard ice making cycle, the condenser fan speed may be between about 60% and about 80% of a maximum fan speed. Accordingly, the condenser fan may be operated at a reduced level or speed (e.g., less than maximum) for the standard ice making cycle.

At step 204, method 200 may include receiving, via the user input, a signal to initiate an adjusted ice making cycle. The appliance may be operating in the normal or standard ice making cycle when the signal is received. In some embodiments, the appliance is not operating prior to receiving the signal. For instance, as user may press a button or a touch input provided on the appliance to activate the adjusted ice making cycle. The adjusted ice making cycle may be referred to as a "turbo ice" mode. For instance, the adjusted ice making cycle may be configured to produce an increased amount of ice (e.g., at an increased rate per hour). Additionally or alternatively, the signal may be a remote signal. For example, a user may use a connected remote device (e.g., smartphone) to input the signal.

At step 206, method 200 may include adjusting the first set of parameters to form a second set of parameters. In detail, the method 200 may adjust one or more operating parameters for the compressor, the motor, or the condenser fan. According to some embodiments, each of the compressor, the motor, and the condenser fan are adjusted. According to still further embodiments, a combination of two of the compressor, the motor, and the condenser fan are adjusted. According to still further embodiments, only one of the compressor, the motor, or the condenser fan is adjusted.

As mentioned, the adjusted ice making cycle may be a turbo ice cycle. For instance, the adjusted ice making cycle may be configured to produce an increased amount of ice per hour over the standard ice making cycle. Accordingly, the second set of parameters may include one or more increased parameters over the first set of parameters.

The second set of parameters may include an adjusted compressor capacity (e.g., adjusted from the first set of parameters). For instance, the adjusted compressor capacity may be increased from the first set of parameters. As mentioned above, the adjusted ice making cycle may be an increased ice making cycle. Accordingly, the adjusted compressor capacity may be greater than about 80% of the total capacity of the compressor. For at least one example, the adjusted compressor capacity is 100% capacity, or maximum capacity. Accordingly, upon receiving the signal, the method 200 (e.g., via the controller) increases the output of the compressor to a maximum capacity to cycle refrigerant through the sealed system more quickly, or at a higher rate.

The second set of parameters may include an adjusted motor speed or power output (e.g., adjusted from the first set of parameters). For instance, the adjusted motor speed may be increased from the first set of parameters. As mentioned above, the adjusted ice making cycle may be an increased ice making cycle. Accordingly, the adjusted motor speed (or output) may be greater than about 80% of the maximum speed (or output) of the motor. For at least one example, the adjusted motor speed is 100%, or maximum motor speed or power. Accordingly, upon receiving the signal, the method 200 (e.g., via the controller) increases the output of the motor to a maximum output to rotate the auger more quickly.

The second set of parameters may include an adjusted fan speed (e.g., adjusted from the first set of parameters). For instance, the adjusted fan speed (e.g., condenser fan speed) may be increased from the first set of parameters. As mentioned above, the adjusted ice making cycle may be an increased ice making cycle. Accordingly, the adjusted fan speed may be greater than about 80% of the maximum fan speed of the condenser fan. For at least one example, the adjusted fan speed is 100%, or maximum fan speed. Accordingly, upon receiving the signal, the method 200 (e.g., via the controller) increases the speed of the fan to a maximum speed to urge or direct more air over the condenser, thus removing more heat from the system to increase the ice production.

At step 208, method 200 may include initiating the adjusted ice making cycle according to the second set of parameters. In detail, upon adjusting one or more of the compressor output, the motor speed, or the fan speed, the method 200 may perform the adjusted ice making cycle to produce the increased amount of ice (or increased ice making rate). In some instances, step 208 includes a seamless transition between the standard ice making cycle and the adjusted ice making cycle (e.g., without pause or interruption to the cycle). In additional or alternative embodiments, the adjusted ice making cycle is initiated from a stand-by or off state of the appliance.

The adjusted ice making cycle may be performed or directed for a predetermined length of time. In detail, a user may provide a set length of time for the adjusted ice cycle to be performed. In some instances, the predetermined length of time is stored on board the appliance (e.g., within a memory or the controller). The predetermined length of time may be preset within the appliance (e.g., during manufacture). Additionally or alternatively, the predetermined length of time may be adjusted according to particular needs of the user. For instance, during parties or large gatherings, the user may set the predetermined length of time for the appliance to perform the adjusted ice making cycle (e.g., 1 hour, 2 hours, 5 hours, etc.). Additionally or alternatively, the adjusted ice making cycle may be performed according to an amount of water supplied to the tank (e.g., water tank 24).

As described herein, a countertop ice maker appliance may incorporate adjustable elements to allow for different ice making rates. For instance, a variable speed compressor, a variable speed condenser fan, and a variable speed motor or motor assembly may be incorporated. Each of the compressor, the condenser fan, and the motor may be adjusted or tuned to specific output levels to produce ice at different rates according to user demand. In a standard ice making cycle, the compressor, the condenser fan, and the motor may be operated at a reduced capacity (e.g., between 60% and 80%) to reduce an energy or electricity consumption of the ice maker appliance. Thus, during times of increased ice usage, at least one of the compressor, the condenser fan, or the motor may be increased or ramped up to produce ice at a faster rate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A countertop ice maker appliance defining a vertical direction, a lateral direction, and a transverse direction, the countertop ice maker appliance comprising:

a cabinet comprising a user interface;

a casing positioned within the cabinet, the casing including a sidewall defining at least a portion of an interior volume of the casing;

a sealed refrigeration system comprising a compressor and a condenser, wherein the compressor is a variable speed compressor, the sealed refrigeration system in thermal communication with the casing wherein operation of the sealed refrigeration system at least partially freezes water within the interior volume thereof;

an auger positioned at least partially within the interior volume of the casing and configured to rotate relative thereto;

an extruder positioned at an output end of the auger and configured to extrude at least partially frozen water within the interior volume of the casing into formed ice pieces;

a motor assembly including a variable speed motor that selectively rotates the auger wherein rotation of the auger moves the at least partially frozen water through the extruder thereby extruding the at least partially frozen water into the formed ice pieces;

a condenser fan to selectively urge a flow of air over the condenser; and a controller operably coupled with the motor assembly, the compressor, and the condenser fan, the controller configured to perform an operation, the operation comprising:

initiating a standard ice making cycle, the standard ice making cycle comprising a first set of parameters for each of the motor assembly, the compressor, and the condenser fan, whereby the motor assembly is operated according to the first set of parameters for the motor assembly, the first set of parameters for the motor assembly including a first motor speed of the variable speed motor;

receiving, via the user interface, a signal to initiate an adjusted ice making cycle;

adjusting the first set of parameters to form a second set of parameters for each of the motor assembly, the compressor, and the condenser fan; and initiating the adjusted ice making cycle whereby the motor assembly is operated according to the second set of parameters for the motor assembly, the second set of parameters for the motor assembly including a second motor speed of the variable speed motor greater than the first motor speed wherein rotation of the auger at the second motor speed moves the at least partially frozen water through the extruder at a faster rate than rotation of the auger at the first motor speed.

2. The countertop ice maker appliance of claim 1, wherein the first set of parameters for the compressor comprises a compressor capacity, the compressor capacity being between 60% and 80% of a total compressor capacity.

3. The countertop ice maker appliance of claim 2, wherein the second set of parameters for the compressor comprises the compressor capacity, the compressor capacity being at the total compressor capacity.

4. The countertop ice maker appliance of claim 1, wherein the first set of parameters for the motor assembly comprises a motor speed, the motor speed being between 60% and 80% of a total motor speed capacity.

5. The countertop ice maker appliance of claim 4, wherein the second set of parameters for the motor assembly comprises the motor speed, the motor speed being the total motor speed capacity.

6. The countertop ice maker appliance of claim 1, wherein the first set of parameters for the condenser fan comprises a fan speed, the fan speed being between 60% and 80% of a maximum fan speed.

7. The countertop ice maker appliance of claim 6, wherein the second set of parameters for the condenser fan comprises the fan speed, the fan speed being the maximum fan speed.

8. The countertop ice maker appliance of claim 1, wherein the motor assembly comprises a brushless direct current (DC) motor.

9. The countertop ice maker appliance of claim 1, wherein the operation further comprises:

directing the adjusted ice making cycle for a predetermined length of time.

10. The countertop ice maker appliance of claim 1, wherein:

initiating the adjusted ice making cycle operates each of the motor assembly, the compressor, and the condenser fan according to the second set of parameters for each of the motor assembly, the compressor, and the condenser fan;

the second set of parameters for the compressor including a second compressor capacity greater than a first compressor capacity of the first set of parameters for the compressor;

the second set of parameters for the condenser fan including a second fan speed greater than a first fan speed of the first set of parameters for the condenser fan; and operation of the compressor at the second compressor capacity and operation of the condenser fan at the second fan speed freezes water within the interior volume of the casing at a faster rate than operation of the compressor at the first compressor capacity and operation of the condenser fan at the first fan speed.

11. The countertop ice maker appliance of claim 10, wherein:

the second motor speed of the motor assembly is a total motor speed capacity;

the second compressor capacity of the compressor is a total compressor capacity; and the second fan speed of the condenser fan is a maximum fan speed.

12. A method of operating a countertop ice maker appliance, the countertop ice maker appliance comprising a sealed refrigeration system including a compressor and a condenser, the countertop ice maker appliance further comprising a condenser fan, an auger configured to rotate, an extruder positioned at an output end of the auger and configured to extrude at least partially frozen water into formed ice pieces, and a motor assembly including a variable speed motor that selectively rotates the auger wherein rotation of the auger moves the at least partially frozen water through the extruder thereby extruding the at least partially frozen water into the formed ice pieces, the method comprising:

initiating a standard ice making cycle, the standard ice making cycle comprising a first set of parameters for each of the motor assembly, the compressor, and the condenser fan, whereby the motor assembly is operated according to the first set of parameters for the motor assembly, the first set of parameters for the motor assembly including a first motor speed of the variable speed motor;

receiving, via a user interface, a signal to initiate an adjusted ice making cycle;

adjusting the first set of parameters to form a second set of parameters for each of the motor assembly, the compressor, and the condenser fan; and initiating the adjusted ice making cycle whereby the motor assembly is operated according to the second set of parameters of the motor assembly, the second set of parameters of the motor assembly including a second motor speed of the variable speed motor greater than the first motor speed wherein rotation of the auger at the second motor speed moves the at least partially frozen water through the extruder at a faster rate than rotation of the auger at the first motor speed.

13. The method of claim 12, wherein the first set of parameters for the compressor comprises a compressor capacity, the compressor capacity being between 60% and 80% of a total compressor capacity.

14. The method of claim 13, wherein the second set of parameters for the compressor comprises the compressor capacity, the compressor capacity being at the total compressor capacity.

15. The method of claim 12, wherein the first set of parameters for the motor assembly comprises a motor speed, the motor speed being between 60% and 80% of a total motor speed capacity.

16. The method of claim 15, wherein the second set of parameters for the motor assembly comprises the motor speed, the motor speed being the total motor speed capacity.

17. The method of claim 12, wherein the first set of parameters for the condenser fan comprises a fan speed, the fan speed being between 60% and 80% of a maximum fan speed.

18. The method of claim 17, wherein the second set of parameters for the condenser fan comprises the fan speed, the fan speed being the maximum fan speed.

19. The method of claim 12, wherein the motor assembly comprises a brushless direct current (DC) motor.

20. The method of claim 12, further comprising:

directing the adjusted ice making cycle for a predetermined length of time.

* * * * *